US008210956B2

(12) United States Patent
Sonner et al.

(10) Patent No.: US 8,210,956 B2
(45) Date of Patent: Jul. 3, 2012

(54) MOTION SWITCH

(75) Inventors: Robert Sonner, South Wales, NY (US); Kyle Bleyle, Alden, NY (US)

(73) Assignee: Mattel, Inc., El Segundo, CA (US)

( * ) Notice: Subject to any disclaimer, the term of this patent is extended or adjusted under 35 U.S.C. 154(b) by 139 days.

(21) Appl. No.: 12/546,875

(22) Filed: Aug. 25, 2009

(65) Prior Publication Data

US 2010/0056016 A1 Mar. 4, 2010

Related U.S. Application Data

(60) Provisional application No. 61/092,588, filed on Aug. 28, 2008.

(51) Int. Cl.
*A63G 13/06* (2006.01)
*A63G 23/00* (2006.01)

(52) U.S. Cl. ..... 472/135; 472/97; 446/175; 200/61.45 R

(58) Field of Classification Search ..... 472/118–125, 472/59–61, 130, 95–97, 135; 446/175, 227, 446/484; 200/61.45 R, 61.45 M, 61.46, 61.47, 200/61.48, 61.51, 61.52, 61.53, 61.83
See application file for complete search history.

(56) References Cited

U.S. PATENT DOCUMENTS

| | | | | |
|---|---|---|---|---|
| 2,424,390 | A | 7/1947 | Ferris | |
| 2,835,759 | A | 5/1958 | Waldow | |
| 3,132,221 | A | 5/1964 | Kachline et al. | |
| 3,141,936 | A | 7/1964 | Boyle et al. | |
| 3,300,603 | A | 1/1967 | Wakely | |
| 3,649,787 | A | 3/1972 | Kasabian | |
| 3,909,569 | A | 9/1975 | Jones | |
| 4,746,774 | A | 5/1988 | Tetrault et al. | |
| 5,001,933 | A | 3/1991 | Brand | |
| 5,565,664 | A | 10/1996 | Chen | |
| 5,801,348 | A | 9/1998 | Asada | |
| 5,845,729 | A | 12/1998 | Smith et al. | |
| 5,951,360 | A * | 9/1999 | Fearon et al. | 446/227 |
| 6,210,167 | B1 * | 4/2001 | Nishiyama | 434/247 |
| 6,297,463 | B1 | 10/2001 | Hills | |
| 6,455,791 | B1 | 9/2002 | Yamashita et al. | |
| 6,646,213 | B2 | 11/2003 | Yamashita | |
| 6,647,788 | B2 | 11/2003 | Murai et al. | |
| 6,720,505 | B2 | 4/2004 | Matsumoto et al. | |
| 6,775,517 | B2 * | 8/2004 | Strebl et al. | 434/309 |
| 6,780,077 | B2 * | 8/2004 | Baumgartner et al. | 446/175 |
| 6,939,194 | B2 * | 9/2005 | Bapst et al. | 446/227 |
| 7,030,327 | B2 | 4/2006 | Matsumoto | |
| 7,151,235 | B1 | 12/2006 | Hill | |
| 7,470,167 | B2 * | 12/2008 | Clark | 446/227 |
| 2003/0117285 | A1 | 6/2003 | Bouillet | |
| 2008/0023308 | A1 | 1/2008 | Chou | |

OTHER PUBLICATIONS

International Search Report for PCT/US2009/054991 dated Feb. 11, 2009, 11 pages.

* cited by examiner

*Primary Examiner* — Kien Nguyen
(74) *Attorney, Agent, or Firm* — Edell, Shapiro & Finnan, LLC

(57) ABSTRACT

A switch or switch mechanism that can be used with an object to detect motion of the object in a particular direction or directions is disclosed. The switch can include two contacts and a conductive mechanism that remains engaged with one contact and that is selectively engageable with the other contact in response to movement in a particular direction.

23 Claims, 11 Drawing Sheets

MOTION SWITCH

CROSS-REFERENCE TO RELATED APPLICATION

This application claims priority to and the benefit of U.S. Provisional Patent Application No. 61/092,588, filed Aug. 28, 2008, entitled "Motion Switch," the entire disclosure of which is incorporated herein by reference in its entirety.

FIELD OF THE INVENTION

The present invention relates to a switch that can be used to detect motion in a particular direction. In particular, the present invention relates to a switch that can be used to detect motion of an object in a particular direction or directions. In one embodiment, the object can be a toy and the switch can be disposed within the toy.

BACKGROUND OF THE INVENTION

There are many types of switches that can be used to detect motion of an object. Typically, a switch is connected to an electronic system that is configured to generate an output in response to the closing of the switch. In some objects, it is desirable to detect when the object is moving in a particular direction but not another direction. For example, it may be desirable to detect when an object is moving in a vertical direction and not a horizontal direction. However, conventional switches are limited in their ability to detect motion in a particular direction.

Therefore, a need exists for a switch that can be used to detect motion of an object in a particular direction or directions. In addition, the need exists for a switch that performs that function while being compact and easy to use.

SUMMARY OF THE INVENTION

The present invention relates to a switch or switch mechanism that can be coupled to an object and used to detect motion of the object. When the object moves, a component of the switch moves as well, thereby facilitating the detection of motion. Depending on the orientation of the switch, movement or motion in a particular direction or directions can be detected.

In one embodiment, the switch that has a pair of contacts and a conductive mechanism that is disposed so that it can engage the contacts. Each of the contacts and the conductive mechanism is either made of a conductive material or has a conductive layer of material disposed thereon. In one embodiment, each contact is configured to be connected to an electronic system, such as by wiring. In a normal, stationary position, the conductive mechanism engages one of the contacts but not the other contact. When the switch is moved, such as by moving the object to which the switch is coupled, the conductive mechanism remains engaged with the first contact and moves into and out of engagement with the second contact. When the conductive mechanism engages both contacts, the switch completes a full circuit and a signal can be generated as current passes through the switch.

In one embodiment, the conductive mechanism includes a resilient portion and a contact portion. The resilient portion is configured to support the contact portion. When the object, and as a result, the switch, move, the weight of the contact portion imparts movement to the resilient portion. Thus, the resilient portion remains engaged with one contact and the contact portion selectively engages the other contact in response to motion of the object and the switch.

In one embodiment, a switch for detecting motion in an object includes a first contact connected to an electronic system, a second contact connected to the electronic system, and a conductive mechanism engaged with the first contact and selectively engageable with the second contact in response to movement of the object along a first direction and at a particular frequency and not to movement of the object along a second direction or at a frequency less than the particular frequency. The conductive mechanism includes a resilient portion and a contact portion, the resilient portion supporting the contact portion for movement. Movement of the object along the first direction at the particular frequency moves the contact portion into and out of engagement with the second contact. In addition, movement of the object in the second direction or at a frequency less than the particular frequency does not result in the contact portion engaging the second contact. In one implementation, the resilient portion is a coiled spring.

In one embodiment, a bouncing toy includes a base, a support coupled to the base and being movable relative to the base, a body coupled to the support and supported for movement relative to the base in a first direction and in a second direction different than the first direction, the body including a riding surface on which a child can sit, and an electronic system including an output device and a motion switch, the motion switch being coupled to one of the body or the support, the motion switch being closed in response to movement of the body in the first direction and not being closed in response to movement of the body in the second direction, the output device generating an output in response to the closing of the motion switch.

In alternative embodiments, the motion switch includes a first contact and a second contact, each of the first contact and the second contact being connected to the electronic system, the motion switch also including a conductive mechanism continuously engaged with the first contact and selectively engageable with the second contact in response to movement of the object in the first direction and not to movement of the object in the second direction. In other embodiments, movement of the body in the first direction moves the conductive mechanism into and out of engagement with the second contact. In addition, movement of the body portion in the second direction does not result in the conductive mechanism engaging the second contact.

In some embodiments, the resilient portion has a natural frequency characteristic and the conductive portion engages the second contact when the body moves at a frequency substantially the same as the natural frequency of the resilient portion. Depending on the orientation of the toy, the first direction is substantially vertical and the second direction is substantially horizontal or rotational.

In another embodiment, the switch includes a container having a wall defining an interior region, the first contact being located at one end of the container and the second contact being located at an opposite end of the container, the resilient portion and the conductive portion being located in the interior region, the conductive portion being selectively engageable with the second contact. The resilient portion defines a longitudinal axis, and the first direction is substantially aligned with the longitudinal axis. The container has a length and the resilient portion has an unbiased length, the unbiased length of the resilient portion being greater than the length of the container. The resilient portion is compressed when the conductive portion is engaged with the resilient portion, the resilient portion when compressed having a length less than the length of the container.

In another embodiment, a toy has a body including a first end and a second end opposite the first end, the body defining a longitudinal axis, the body being movable in a first direction and in a second direction by a user, and a motion switch coupled to the body, the motion switch having a primary axis along which a component of the motion switch can move, the primary axis being substantially aligned with the longitudinal axis of the body, the motion switch being closed in response to movement of the body along the first direction and not being closed in response to movement of the body along the second direction. The motion of the body in the first direction is a swinging motion within a plane and the motion of the body in the second direction is not along the plane.

BRIEF DESCRIPTION OF THE DRAWINGS

Like reference numerals have been used to identify like elements throughout this disclosure.

DETAILED DESCRIPTION OF THE INVENTION

The present invention relates to a switch that can be used to detect motion of an object in a particular direction or directions. For example, the switch can be used to detect motion of the object in a first direction and not motion of the object in a second direction, depending on the orientation of the switch. The switch may include a conductive mechanism that selectively engages a contact in response to movement along a first direction and not to movement along a second direction. The terms "switch," "switch portion," and "switch mechanism" may be used interchangeably herein. In addition, the terms "contact member" and "conductive member" may be used interchangeably herein.

Figure 1A:
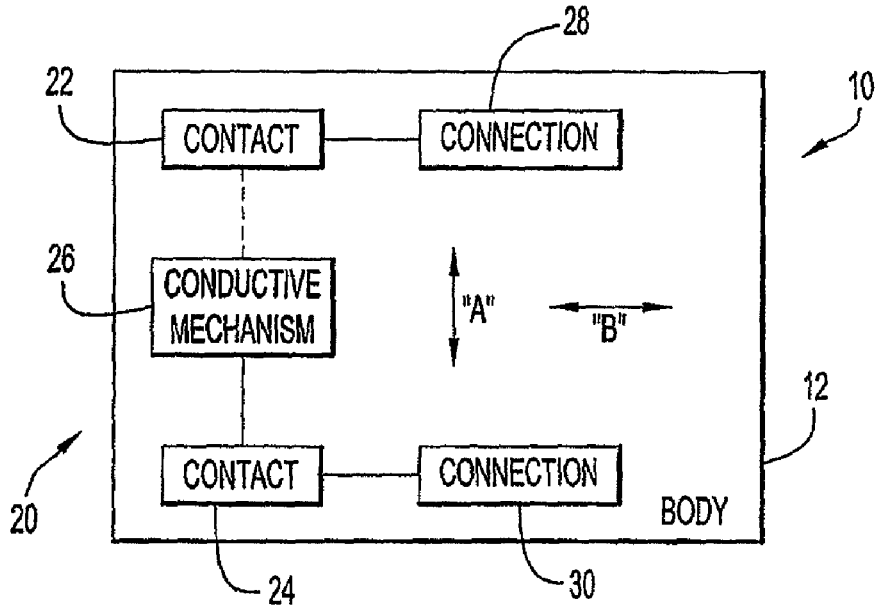
FIGS. 1A and 1B illustrate schematic block diagrams of an embodiment of a switch according to the present invention.

Referring to FIG. 1A, a schematic block diagram of an exemplary embodiment of a switch that can be used with an object, such as a toy, a riding device, or other structure, according to the present invention is illustrated. The object 10 includes a body 12 that has a switch or switch portion 20 coupled thereto. The body 12 of the object 10 can be moved along any direction, such as along the direction of arrow "A" and along the direction of arrow "B." In one implementation, the direction of arrow "A" can be a vertical or substantially vertical direction, such as in an up-and-down manner. The direction of arrow "B" can be a horizontal or substantially horizontal direction, such as in a side-to-side manner. In other embodiments, the directions of arrows "A" and "B" can be any directions as desired. For example, arrow "A" can represent horizontal movement and arrow "B" can represent vertical movement.

As illustrated, the switch portion 20 includes contacts 22 and 24 and a conductive mechanism 26. The contacts 22 and 24 are spaced apart from each other. In one implementation, the conductive mechanism 26 is in engagement with contact 24 and moveable into engagement with contact 22 (as represented by the dashed line). As the body 12 moves along the direction of arrow "A," the conductive mechanism 26 intermittently engages contact 22 during such movement. As the body 12 moves along the direction of arrow "B," the conductive mechanism 26 does not engage contact 22.

Contact 22 is made of a conductive material and has a connection 28 that can be connected to an electronic system by wiring or other conductive materials. Similarly, contact 24 is made of a conductive material and has a connection 30 that can be connected to wiring or other conductive material as well. Since the conductive mechanism 26 remains in contact and engagement with contact 24, a full circuit is formed when the conductive mechanism 26 engages contact 22. The engagement of conductive mechanism 26 with contact 22 closes the switch or switch portion 20 and a signal is generated, indicating that the switch 20 is closed.

The conductive mechanism 26 can move along any direction. Therefore, when the conductive mechanism 26 moves along the direction of arrow "A," the conductive mechanism 26 moves into and out of engagement with contact 22, which causes the switch 20 to open and close. When the conductive mechanism 26 moves along the direction of arrow "B," the conductive mechanism 26 does not engage the contact 22, and the switch 20 does not close.

Figure 1B:
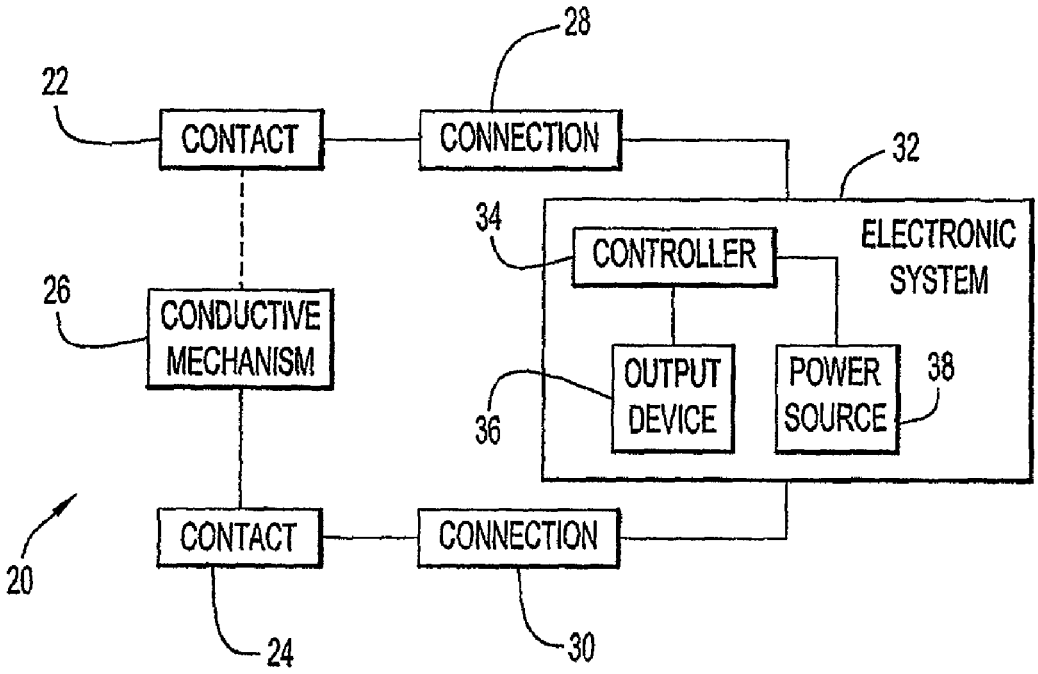

Referring to FIG. 1B, an exemplary embodiment of an electronic system is illustrated. The electronic system 32 is connected to connections 28 and 30 and includes a controller 34, an output device 36, and a power source 38. The electronic system 32 may include additional components not illustrated in FIG. 1B. In different embodiments, the output device 36 can be any type of device that can generate a visual and/or audible output, such as a speaker or transducer or a light or illumination device. The particular outputs generated by the electronic system 32 can vary in response to the closing of the switch 20 or the engagement of the conductive mechanism 26 with the contact 22.

Figure 2:
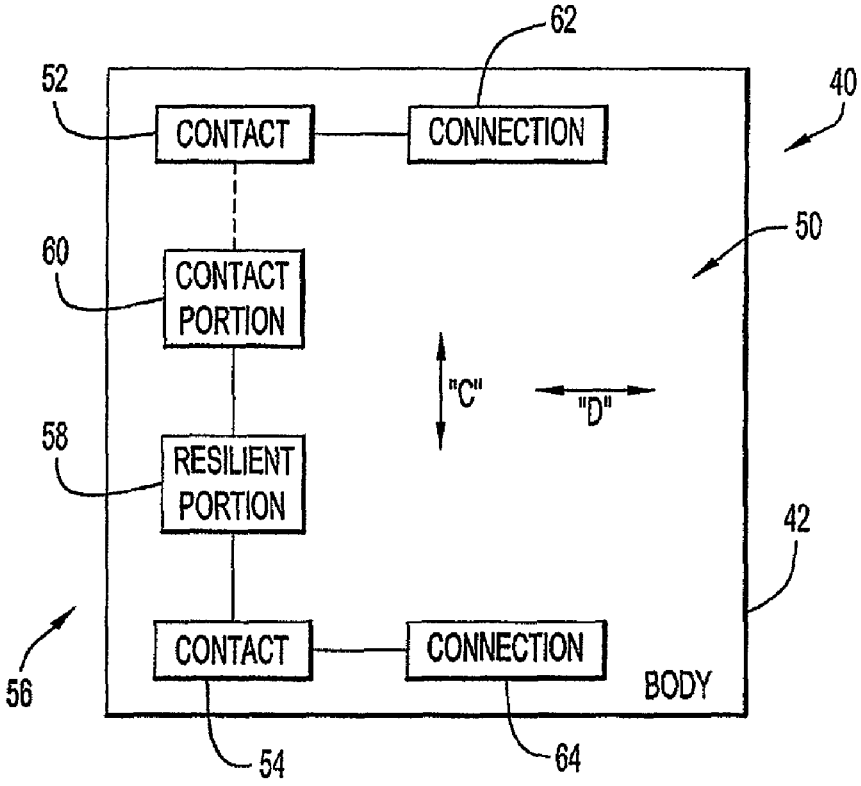
FIG. 2 illustrates a schematic block diagram of an alternative embodiment of a switch according to the present invention.

Referring to FIG. 2, an alternative embodiment of an object 40 is illustrated. In this embodiment, the object 40 includes a body 42 to which a switch or switch portion 50 is coupled. The switch 50 includes a contact 52 with a connection 62 and another contact 54 with a connection 64. The contacts 52 and 54 are spaced apart and are either made of a conductive material or have a conductive coating.

The switch 50 includes a conductive mechanism 56 that has a resilient portion 58 and a contact portion 60. The resilient portion 58 is configured to support the contact portion 60 for movement. In one embodiment, the resilient portion 58 and the contact portion 60 are each made of a conductive material so the switch 50 is "closed" when the contact portion 60 moves into engagement with contact 52. The resilient portion 58 can have resilient properties such that it supports the contact portion 60 for movement along any direction. In one implementation, the resilient portion can be a spring or spring-like member that is placed in contact with contact 54. When contact portion 60 moves along the direction of arrow "C" and engages contact 52, the circuit or switch 50 is closed upon such engagement. However, if the contact portion 60 moves along the direction of arrow "D," contact portion 60 does not engage contact 52 and the switch 50 does not close.

Figure 3:
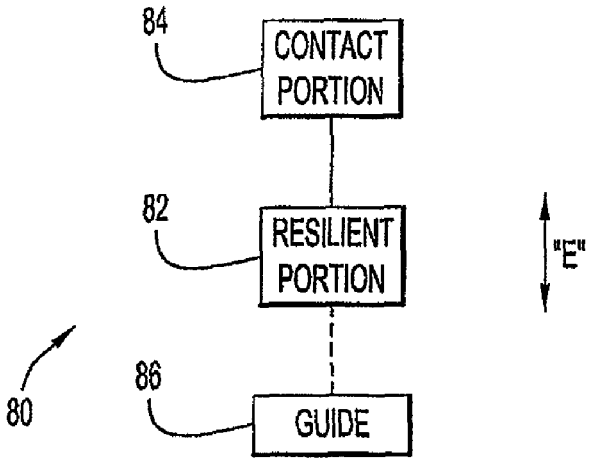
FIG. 3 illustrates a schematic block diagram of an embodiment of conductive mechanism for a switch according to the present invention.

Referring to FIG. 3, a schematic block diagram of an alternative embodiment of some components of a switch is illustrated. The switch or switch portion 80 includes a resilient portion 82 and a contact portion 84. The contacts that the resilient portion 82 and the contact portion 84 engage are not illustrated in FIG. 3 for ease of reference only. In this embodiment, the body of the switch 80 includes a guide 86 that maintains the resilient portion 82 in a particular orientation and position. In other words, the guide 86 is configured so that the contact portion 84 is moved along the direction of arrow "E" primarily.

Figure 4:
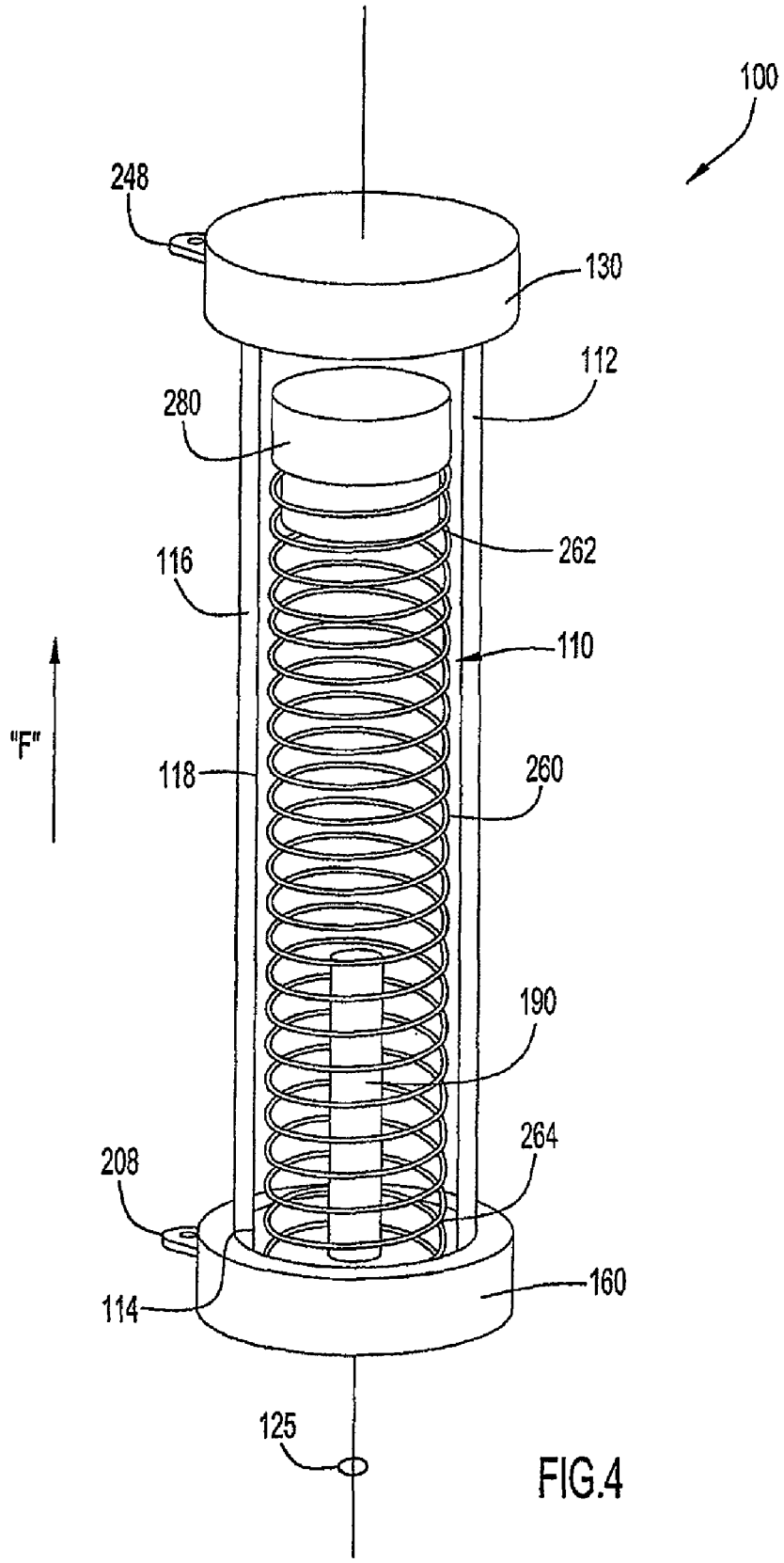
FIG. 4 illustrates a front perspective view of an embodiment of a switch according to the present invention.

Referring to FIG. 4, an embodiment of a switch according to the present invention is illustrated. In this embodiment, the switch 100 includes a body or container 110 that has opposite ends 112 and 114. In one embodiment, the container 110 is a tube. The body 110 includes a wall 116 that forms a channel, interior region, or inner area 118. Coupled to end 112 is a cap or end portion 130. Similarly, coupled to end 114 is a cap or end portion 160. In one embodiment, the end portions 130 and 160 are press-fit onto the ends 112 and 114 of the body 110 and retained by friction. A user can remove the end portions 130 and 160 from the body 110 as desired. The cap 130 includes an extension 248 that extends therefrom and to which wiring or a conductive member may be connected. Similarly, cap 160 includes an extension 208 that extends therefrom and to which wiring or a conductive member may be connected.

In this embodiment, the switch 100 includes a resilient member or portion 260 and a conductive or contact member 280. The resilient member 260 is a spring that supports the conductive member 280 for movement. In particular, the conductive member 280 is supported for movement by the resilient member 260 along the direction of arrow "F." The resilient member 260 has ends 262 and 264 that are disposed proximate to end portions 130 and 160, respectively. The switch 100 includes a primary axis 125 as shown in FIG. 4. In this embodiment, the primary axis 125 is also the longitudinal axis of the switch 100.

Figure 5:
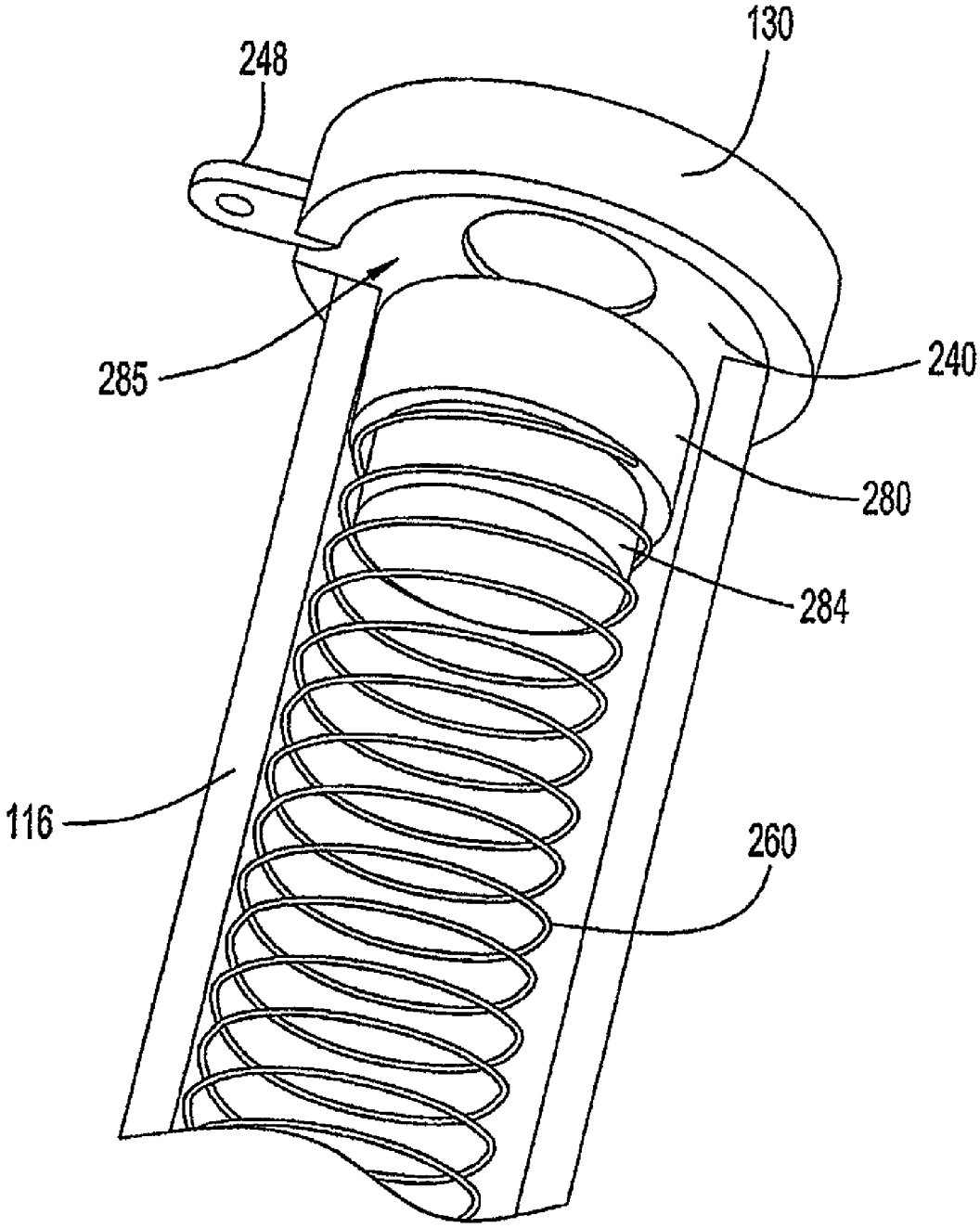
FIG. 5 illustrates a portion of the switch illustrated in FIG. 4.

Referring to FIG. 5, a close-up view of a portion of the switch 100 including wall 116 is illustrated. As shown, on the inner side of end portion 130 is a contact 240 that is selectively engaged by the contact member 280. The contact 240 includes an extension or connection 248 to which wiring or other conductive member is connected. The contact member 280 includes a lower or mounting portion 284 that is sized to be seated in the opening formed in the end 262 of the resilient member 260. As shown, there is a gap 285 at the top between the contact 240 and the contact member 280. The size of the gap 285 determines the amount of force required to close the switch. The size of the gap 285 can be varied by adjusting the mass of the contact member 280. In one implementation, the gap distance is approximately 4.2 mm or 0.17 inches.

Figure 6:
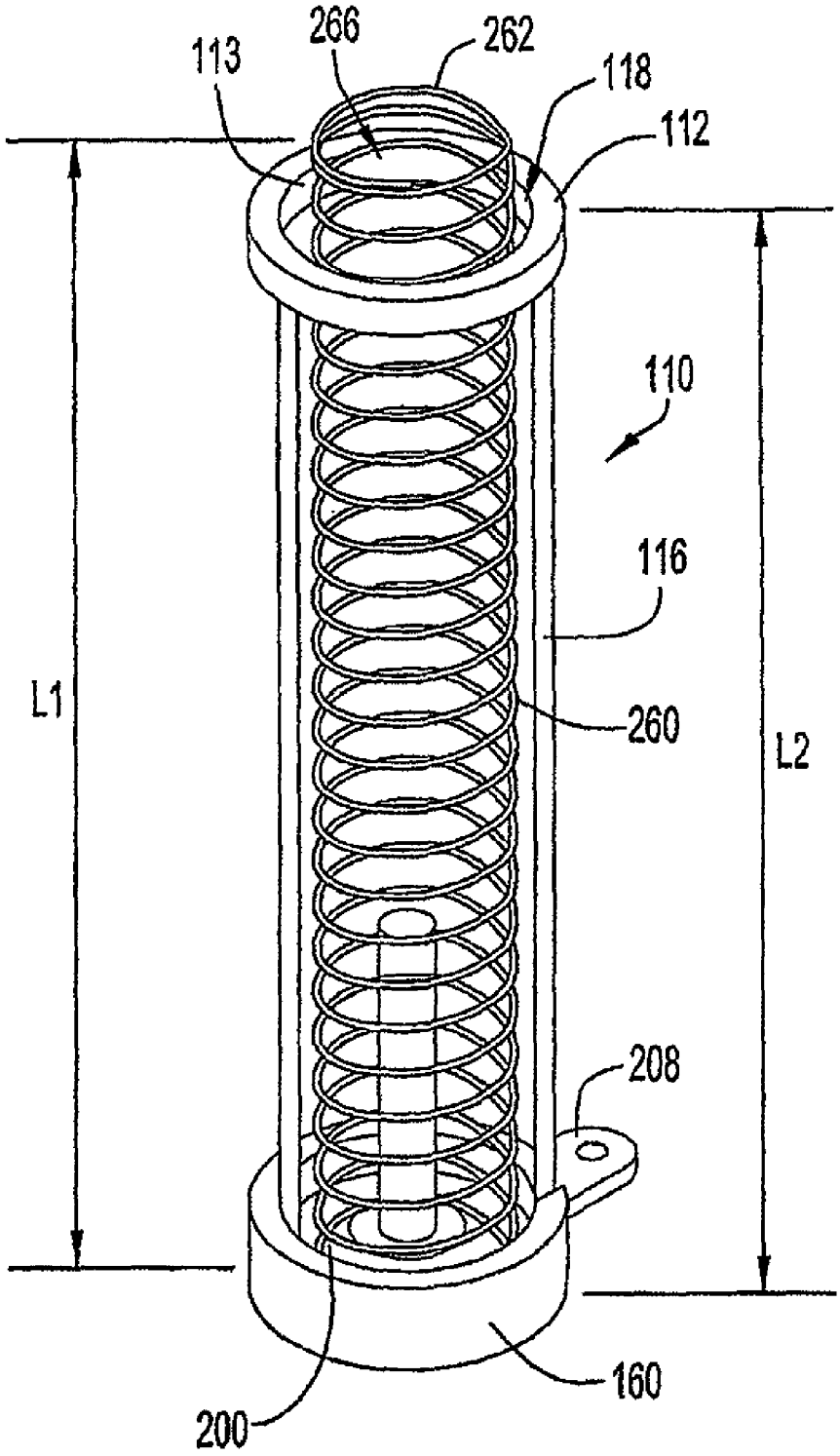
FIG. 6 illustrates a front perspective view of the switch illustrated in FIG. 4 with one of the end portions removed.

Referring to FIG. 6, the switch 100 is illustrated with end portion 130 removed. The contact member 280 is removed from end 262 of the resilient member 260, thereby allowing the resilient member 260 to extend to its full unbiased length, shown as L1. In this embodiment, the length L1 of the resilient member 260 is greater than the length L2 of the body 110 which includes wall 116 that defines the channel 118. Accordingly, the end 262 of the resilient member 260 extends through the opening 113 at the end 112 of the body 110. The end 262 forms a receiving area 266 into which the lower portion 284 of the contact portion 280 is inserted. Also shown in FIG. 6 is the lower end portion 160 that has a contact 200 with an extension 208.

Figure 7:
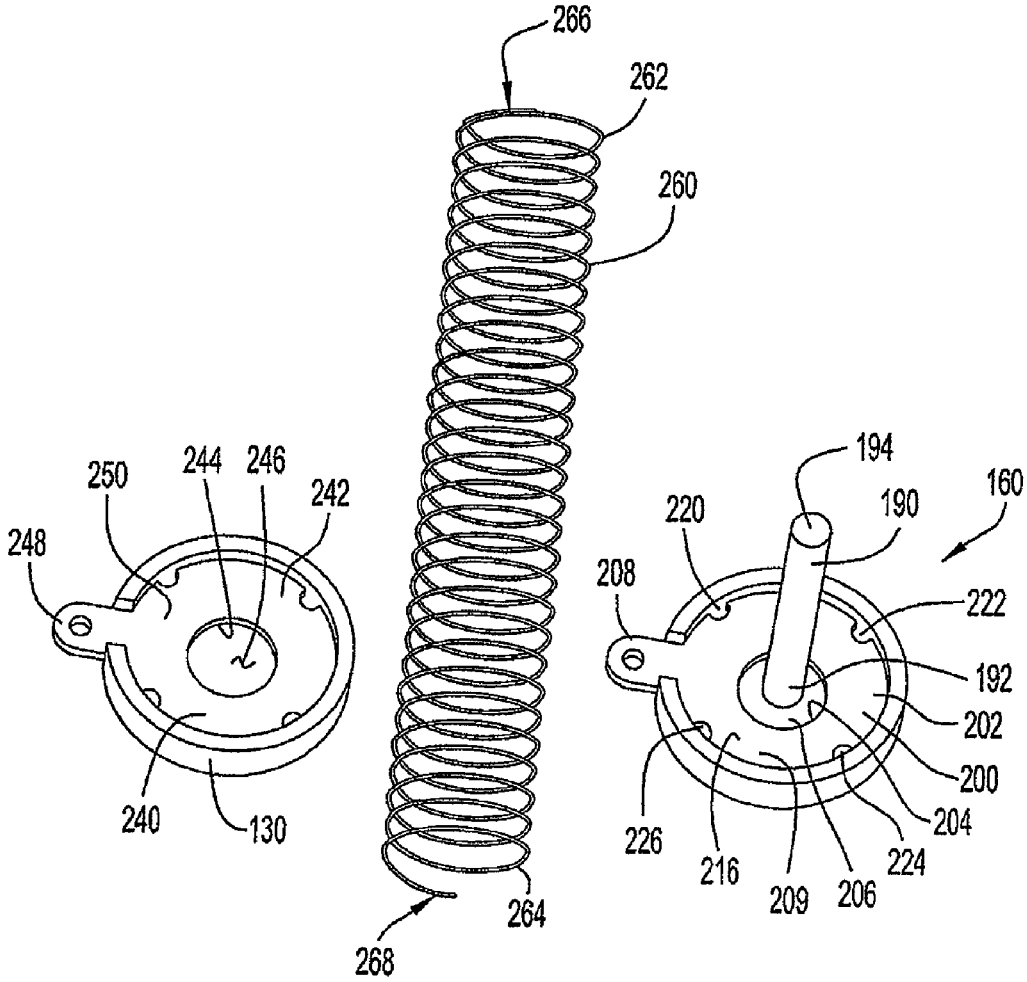
FIG. 7 illustrates a view of some of the components of the switch illustrated in FIG. 6.

Referring to FIG. 7, some of the components of the switch 100 are illustrated. As shown, the resilient member 260 has ends 262 and 264 that define receiving areas 266 and 268. End portions 130 and 160 are illustrated as well. End portion 160 includes a contact 200 coupled thereto. Similarly, end portion 130 includes a contact 240 coupled thereto.

The end portion 160 includes a guide 190 that is located proximate to the middle of the end portion 160 and that extends upwardly (see FIG. 4). The guide 190 includes an end 192 that is coupled to the end portion 160 and an opposite free end 194. The guide 190 is configured to be inserted into the receiving area 268 formed in the end 264 of the resilient member 260.

As shown in FIG. 7, the contact 200 includes a body 202 with an inner edge 204 that defines an opening 206. The opening 206 is configured to receive the guide 190. The body 202 includes an extension 208 that extends outwardly beyond the end portion 160 and a contact surface 209 that is engaged by the resilient member 260. The contact 200 is made of a conductive material or has a conductive layer of material disposed thereon. Similarly, contact 240 includes a body 242 with an inner edge 244 that defines an opening 246. The body 242 includes an extension 248 and a contact surface 250 that is engaged by the contact member 280. Thus, in use, the resilient member 260 engages contact 200 on end portion 160 and the contact member 280 engages contact 240 on end portion 130.

Figure 8:
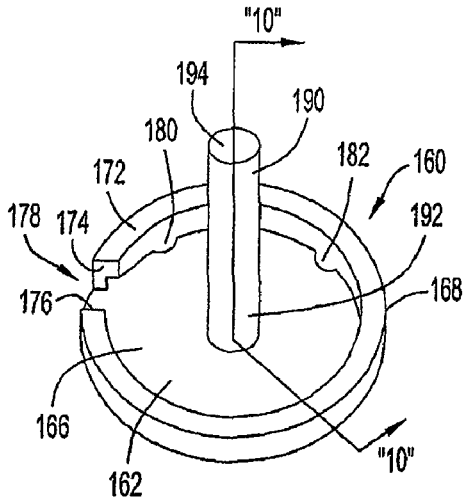
FIG. 8 illustrates a perspective view of an embodiment of an end portion according to the present invention.
Figure 9:
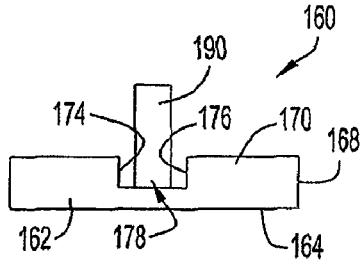
FIG. 9 illustrates a side view of the end portion illustrated in FIG. 8.
Figure 10:
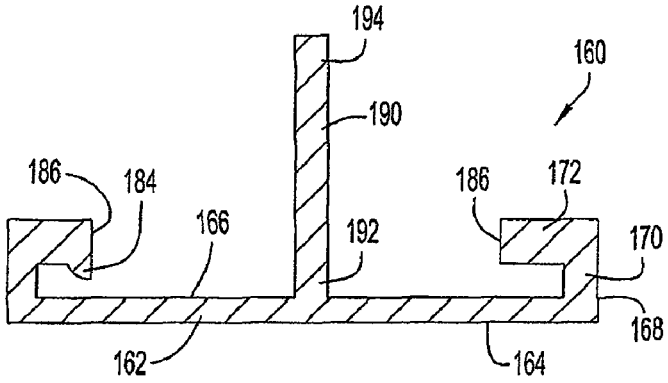
FIG. 10 illustrates a cross-sectional view of the end portion illustrated in FIG. 8 taken along the line "10-10."

Referring to FIGS. 7-10, several different views of the cap or end portion 160 are illustrated. End portion 160 includes a body 162 with an outer surface 164 and an inner surface 166 that is disposed to face the inside of the container 110. The body 162 has a perimeter 168 that extends around the body 162. As shown in FIG. 10, a flange 170 extends around substantially all of the perimeter 168 of the body 162. A rim 172 extends inwardly from the flange 170 substantially along the length of the flange 170. As shown in FIGS. 8 and 9, the flange 170 and rim 172 have ends 174 and 176 that define a slot or notch 178. The notch 178 is configured to receive the extension 208 of contact 200.

Now the particular features of the end portion 160 that are used to mount the contact 200 to the end portion 160 are described. The rim 172 includes several depending projections 180, 182, and 184 that are spaced around the length of the rim 172. In various embodiments, different quantities of projections can be provided on the end portion 160. As shown in FIG. 10, the rim 172 includes an inner edge 186. Contact 200 can be press-fit into engagement with the end portion 160 and the outer perimeter of the contact 200 can be disposed in the area or channel formed by the flange 172 and the rim 174.

While the foregoing description relates to the end portion 160, end portion 130 has substantially the same structure with the exception of guide 190. End portions 130 and 160 are made of a non-conductive material, such as a molded plastic, and guide 190 can be formed integrally with the remainder of end portion 160. In other embodiments, the size and shape of the guide 190 can vary as well as the manner in which the guide 190 is formed with the end portion 160.

Figure 11:
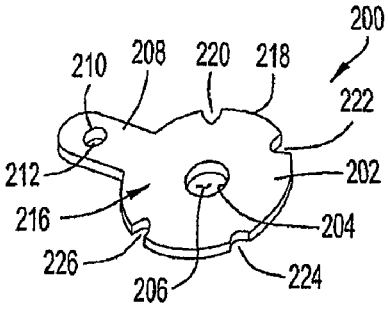
FIG. 11 illustrates a perspective view of an embodiment of a contact according to the present invention.
Figure 12:
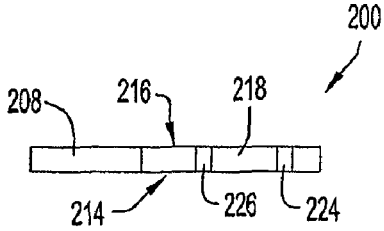
FIG. 12 illustrates a side view of the contact illustrated in FIG. 11.

Referring to FIGS. 11 and 12, an embodiment of a contact according to the present invention is illustrated. In this embodiment, the contact 200 includes a body 202 that has an edge 204 defining an opening 206. The body 202 includes an extension 208 that has an opening 212 formed therein by an edge 210. The body 202 has an outer surface 214 and an inner surface 216 that is contacted by the resilient member 260. The perimeter or outer edge 218 of the body 202 extends substantially around the body 202 as shown. Formed along the perimeter 218 are notches 220, 222, 224, and 226, which are aligned with the projections on the cap portion 160, including projections 180, 182, and 184. The engagement of the projections with the notches assists with the retaining of the contact 200 to the end portion 160.

Figure 13:
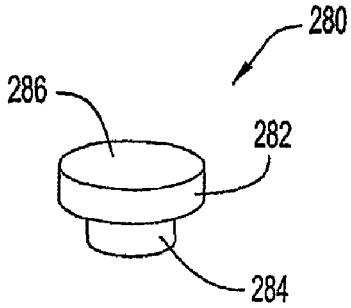
FIG. 13 illustrates a perspective view of an embodiment of a conductive member according to the present invention.
Figure 14:
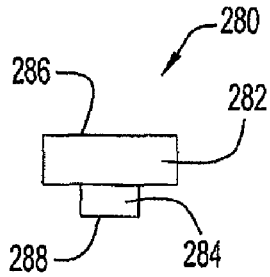
FIG. 14 illustrates a side view of the conductive member illustrated in FIG. 13.

Referring to FIGS. 13 and 14, an embodiment of a conductive or contact member is illustrated. In this embodiment, the contact member 280 includes an upper or contact portion 282 and a lower or mounting portion 284. The contact portion 282 includes a contact surface 286 that is configured to engage the contact 240. The mounting portion 284 includes a lower surface 288 as well. While the contact portion 282 and the mounting portion 284 are cylindrical in this embodiment, in alternative embodiments, the shapes and relative sizes of the portions can vary. Mounting portion 284 is configured to be inserted into the receiving area 266 formed in the upper end 262 of the resilient member 260, as previously described.

Figure 15:
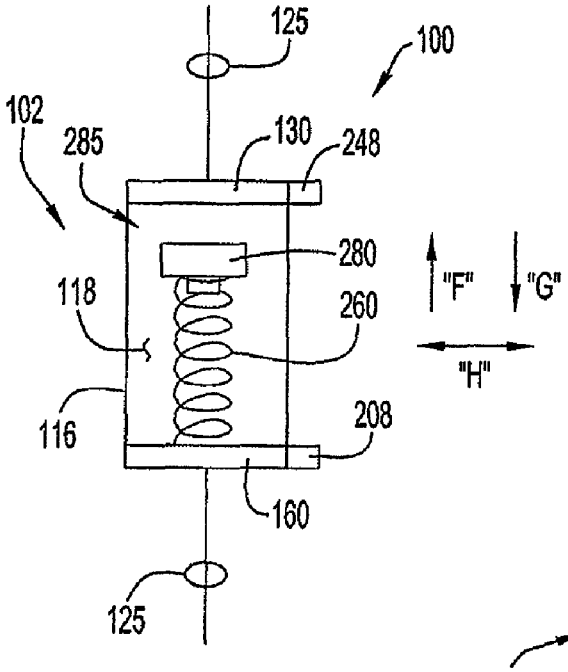
FIG. 15 illustrates a side view of the switch illustrated in FIG. 4 in a first configuration.
Figure 16:
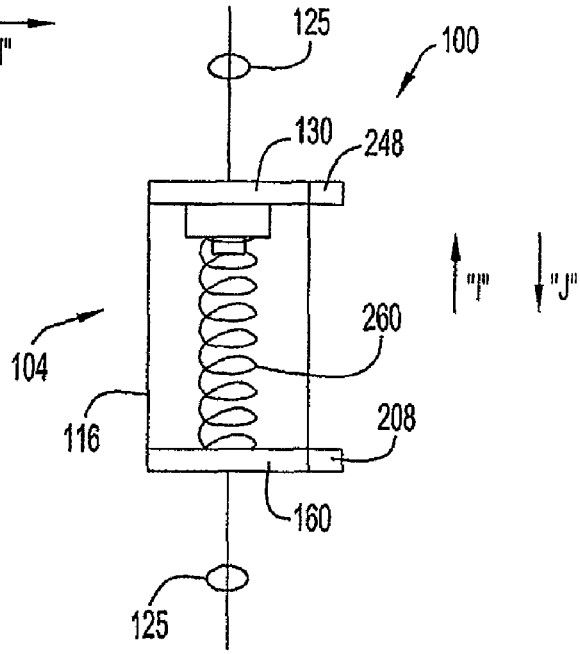
FIG. 16 illustrates a side view of the switch illustrated in FIG. 4 in a second configuration.

Referring to FIGS. 15 and 16, exemplary configurations of the switch 100 are illustrated. As shown, the switch 100 includes a container 116 defining a receptacle 118 in which a resilient member 260 and a conductive member 280 are disposed. The switch 100 has a primary axis 125 based on its configuration. In this embodiment, the primary axis 125 is also the longitudinal axis of the switch 100. End portions 130 and 160 with extensions 248 and 208, respectively, are illustrated as well. It is to be understood that contacts 240 and 200 are coupled to end portions 130 and 160, even though the contacts are not illustrated in FIG. 15 for ease of reference only.

Referring to FIG. 15, the weight of conductive member 280 causes the resilient member 260 to compress, thereby providing a space or gap 285 above the conductive member 280 for movement. As mentioned above, the distance of the gap 285 determines the amount of force that needs to be applied to the container 116 and the contact member 280 to bring the contact member 280 into engagement with contact 240 to close the switch 100. The force can be applied by moving the container 116.

The container 116 and accordingly, the switch 100, can be moved randomly in space in any combination of directions. For example, the container 116 can be moved in any combination of up-and-down directions, side-to-side directions, and front-to-back directions, which can correspond to various planes, such as a horizontal plane as well as different vertically oriented planes. In addition, the container 116 can be moved in different rotational directions. Although all of those movements are possible, the container 116 can be used to detect motion in a particular direction. In one embodiment, the desired direction of motion to be detected is along the primary axis of the switch 100.

Referring to FIG. 15, as the container 116 moves along the direction of arrow "F1," conductive member 280 initially moves along the direction of arrow G," thereby compressing the resilient member 260. Then, referring to FIG. 16, as the container 116 moves along the direction of arrow "J," the conductive member 280 moves along the direction of arrow "I." As shown, when the conductive member 280 moves on the resilient member 260 along the direction of arrow "I" a sufficient distance, conductive member 280 engages the contact 240 that is coupled to the end portion 130, thereby closing the switch 100. Repeated movement of the container 116 along the directions of arrows "F1" and "G" in FIG. 15 and the directions of arrows "I" and "J" in FIG. 16 will result in repeated engagement of the conductive member 280 with the contact 240 and the closing of the switch 100.

Referring back to FIG. 15, movement of the container 116 along the directions of arrow "H" does not impart movement to the conductive member 280 along the direction of either arrow "F1" or arrow "G." Accordingly, conductive member 280 does not engage the contact 240 and the switch 100 does not close in response to such movement of the container 118. The switch 100 as illustrated in FIG. 15 has a first configuration 102 corresponding to an open position of the switch 100. In addition, the switch 100 as illustrated in FIG. 16 has a second configuration 104 corresponding to a closed position of the switch 100. As shown, the first configuration 102 of the switch 100 and its components is different than the second configuration 104 of the switch 100 and its components.

Figure 17:
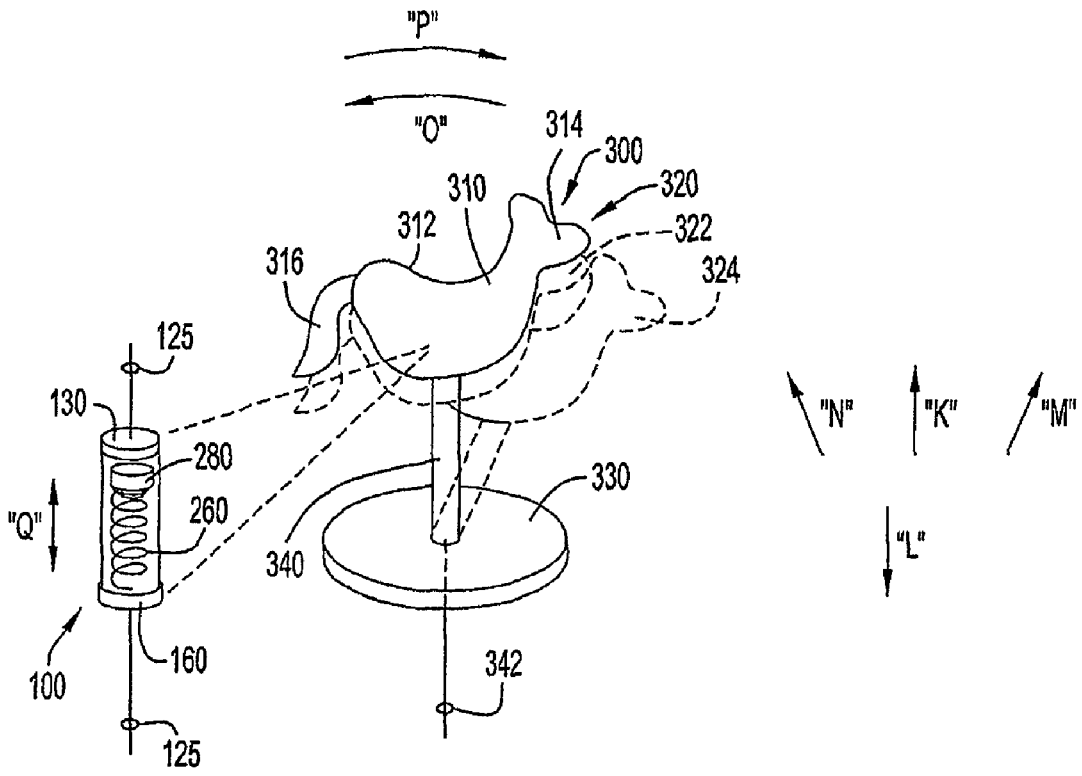
FIG. 17 illustrates a perspective view of an embodiment of an object that can be used with a switch according to the present invention.
Figure 18:
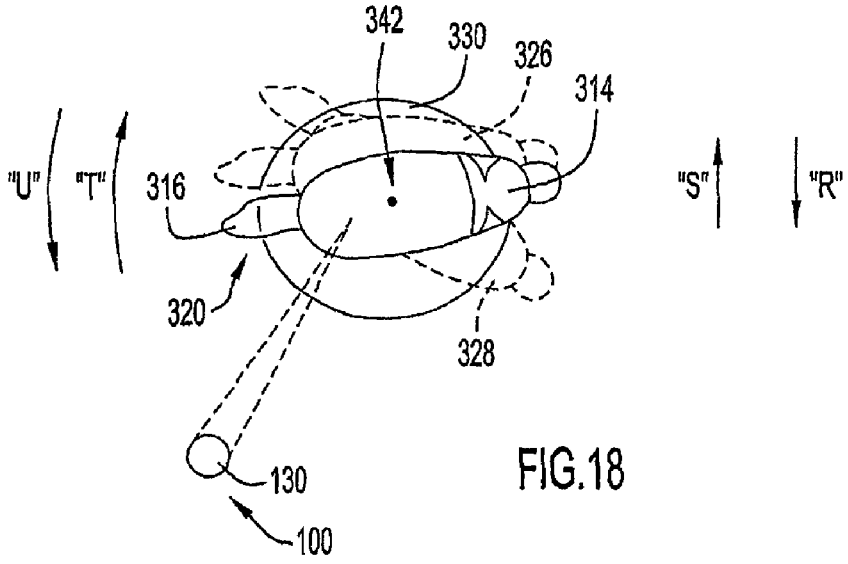
FIG. 18 illustrates a top view of the object illustrated in FIG. 17.

Referring to FIGS. 17 and 18, an embodiment of an object with which the switch 100 can be used is illustrated. FIG. 17 illustrates a side perspective view of the object and FIG. 18 illustrates a top view of the object. The object illustrated in FIGS. 17 and 18 is a ride-on device that is configured so that a child can sit thereon and move in different directions. In one embodiment, the object can resemble an animal, such as a zebra or a pony. It is to be understood that the object illustrated in FIGS. 17 and 18 is exemplary only and that different embodiments of an object can be used with the switch according to the present invention.

As shown in FIG. 17, the object 300 is mounted on a support 340 that is coupled at one end to the object 300 and at its other end to a base 330. The base 330 is configured to be placed on a support surface, such as the ground, a floor, etc. In this embodiment, the object 300 includes a body 310 with an upper or riding surface 312 on which a child can sit and a head 314 and a tail 316.

The support 340 is an elongate member that has resilient properties and a longitudinal axis 342. In one embodiment, the support 340 is a resilient member such as a spring. An upper end of the support 340 can be moved relative to a lower end of the support 340, thereby permitting the support 340 to flex and bend in any direction relative to the base 330. The object 300 is connected to the support 340 and therefore, the object 300 moves in the same direction as the upper end of the support 340. For example, the support 340 can lengthen and shorten as a child bounces on the object 300. Accordingly, the body 310 can move from an initial, unbiased position 320 to a lower position 322 (shown in phantom). In addition, the child can rock forward and backward on the object 300, and the body 310 can move to a forward position 324. Further, as shown in FIG. 18, the body 310 of the object 300 can move laterally to position 326 as well as rotate or twist about the longitudinal axis 342 of the support 340 to another position 328.

As illustrated in FIGS. 17 and 18, the object 300 can move in many different directions and within many different planes. For example, the object 300 can be moved in a vertical plane defined by the forward movement along the direction of arrow "P" and the rearward movement along the direction of arrow "O." The object 300 can also move in a vertical or substantially vertical direction upwardly along the direction of arrow "K" and downwardly along the direction of arrow "L." While the directions of arrows "K" and "L" are along the longitudinal axis 342 of the support 340, the object 300 can also move upwardly and downwardly in directions offset from the axis 342, such as along the directions of arrows "M" and "N." As shown in FIG. 18, the object 300 can move laterally from side-to-side along the directions of arrows "R" and "S" in another plane. Additionally, the object 300 can rotate or twist about the axis 342 along the directions "U" and "T." While not illustrated, the object 300 can move and rotate at the same time, thereby making a complex move. As can be understood, the support 340 enables the movement of the object 300 in numerous directions.

While the object may have numerous types and directions of movement, detection of movement of the object in a particular direction or directions may be desired. In one example, detection of movement of the object 300 along an upward direction and downward direction is desired and not movement in any of the other directions.

Movement of the object 300 upwardly and downwardly can be detected by using the switch 100. In FIG. 17, the orientation of the switch 100, as determined by its primary or detecting axis 125, for detecting motion of object 300 along the upward and downward directions is illustrated. The conductive member 280 is located on the resilient member 260 such that it moves along the directions of arrow "Q." which corresponds to the motion of object 300 along the directions of arrows "K" and "L." Accordingly, movement of the object along the directions of arrows "M," "N," "O," and "P" in FIG. 17 does not result in the closing of the switch 100 or the engagement of the conductive member 280 with the contact associated with cap 130.

Referring to FIG. 18, only the cap 130 of the switch 100 is visible in this view as FIG. 18 illustrates a top view of the object 300. In this orientation, the conductive member 280 engages the contact of cap 130 only for movement toward and away from the base 330. Accordingly, the switch 100 does not close in response to movement of the object 300 along the directions of arrows "R." "S." "T." or "U."

The switch 100 can be located at any location on the body 310, including being mounted internally or externally. The particular motion detected is determined by the orientation of the switch 100. In an alternative embodiment of the object 300, two switches 100 can be provided. In this embodiment, one switch 100 can be located so that its axis is aligned with the directions of arrows "K" and "L" in FIG. 17, thereby detecting motion in the up-and-down directions. Another switch 100 can be located so that its axis is aligned with the directions of arrows "R" and "S" in FIG. 18, thereby detecting motion in the side-to-side or lateral directions. The electronic system can be configured so that different outputs are generated in response to the different motions detected by the different switches. For example, different sound effects can be generated when the object moves up and down as compared to when the object moves side-to-side.

The present invention also contemplates another method or manner of detecting the motion of an object. The motion of an object is to be detected along a particular direction if the motion was oscillatory in nature and within a particular frequency range. In this case, motion of an object, such as a child's toy that can be bounced up and down, is to be detected when the object is being played with in a particular manner. For example, an object such as the bouncing object 300 described previously can be used by a child to move in a variety of directions. The object 300 can be configured so that when a child is bouncing on the object 300 with a particular intent and at a particular level of energy or effort, a switch associated with the object 300 is closed and one or more audible and/or visual outputs can be generated. As described in greater detail below, the particular play by the child to be detected can be determined by using a switch such as switch 100 that has a primary or detecting direction and a resilient or biasing member such as a spring therein.

In this particular detecting method, the movement of an object, such as object 300, at particular speed and in a particular direction will result in the closing of a switch associated with the object and accordingly, the detection of the motion of the object. Each spring or spring system has its own natural frequency, which, when matched by a vibration frequency, will resonate. The switch 100 includes a biasing member or spring 260 that has a natural frequency that is determined by various characteristics of the spring 260, including its thickness, length, and material. As the flexibility of a spring increases (such as due to its thickness and/or material changing), its natural frequency lowers. Alternatively, the more rigid that a spring is, the natural frequency is higher. Alternatively, the addition of a weight or mass, such as conductive member 280, to a spring lowers the resonance frequency of the spring 260. In one embodiment of the invention, the natural frequency of the spring 260 is approximately 3 Hz. In other embodiments, the natural frequency can vary and can be greater or less than 3 Hz as desired. The spring 260 that is used in the switch 100 can be selected so that its natural frequency closely matches the natural frequency of the object 300 whose motion is being detected.

In this embodiment, the detection of movement occurs if the object 300 is moved at the desired speed and along the desired direction as determined by the spring 260 and the conductive member 280 that are used in the switch 100. The spring 260 is mounted between two contacts 200 and 240 in the switch 100. The spring 260 continuously engages contact 200 and the conductive member 280 that is disposed on the other end of the spring 260 is located so that it can engage and disengage from contact 240 as the moving end of the spring 260 oscillates with the conductive member 280.

Thus, when the object 300 is moved along the primary or longitudinal direction of the spring 260 and at a frequency very close to the natural frequency of the spring 260, the conductive member 280 coupled to the spring 260 will move with a frequency determined in part by the mass of the conductive member 280 and the characteristics of the spring 260. When the frequency of the movement of the conductive member 280 and the spring 260 is at or near the natural frequency of the spring 260, the movement of the object will have a frequency that will result in the closing of the switch 100. The result is that the conductive member 280 moves into and out of engagement with the contact 240 of the switch 100 one or more times, depending on how long the object 300 is moved in that oscillatory manner.

If the motion of the object 300 is either too fast or too slow, the switch 100 is not closed. If the object 300 is moved only once, the switch 100 is not closed. Accordingly, motion of an object, such as a child bouncing or moving the object, in the desired range of speed and in an oscillatory manner will result in the switch 100 closing and the generation of an output, such as a visual output or an audible output, as a reward. Thus, in this embodiment, the conductive member 280 does not engage contact 240 to close the switch 100 unless the object 300 is moved at the proper speed and direction in the proper manner.

Figure 19:
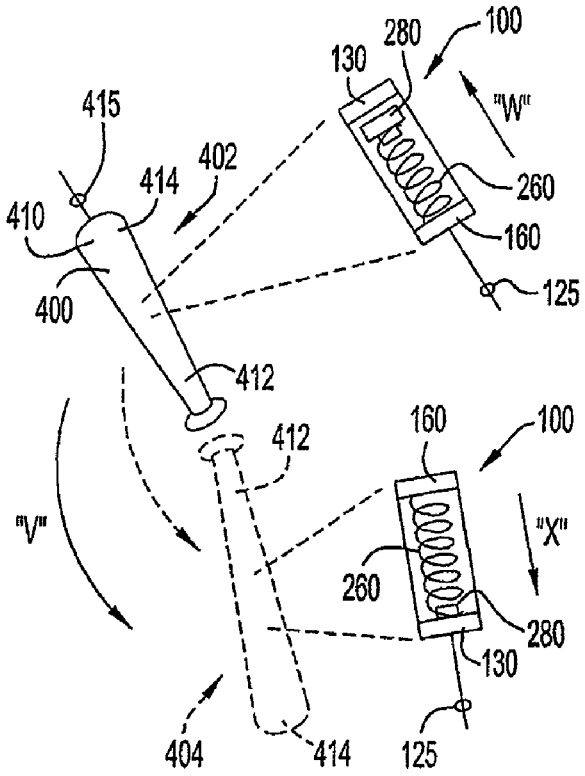
FIG. 19 illustrates a top view of an alternative embodiment of an object that can be used with a switch according to the present invention.
Figure 21:
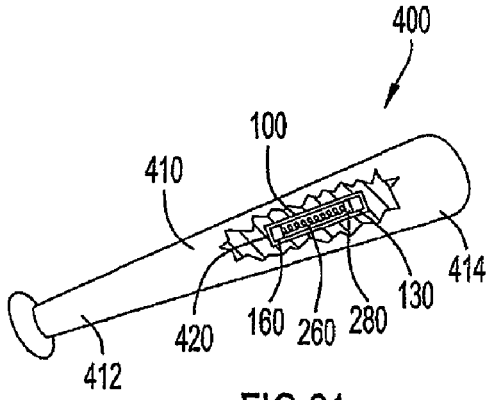
FIG. 21 illustrates a partial internal view of a portion of the object illustrated in FIG. 19.
Figure 20:
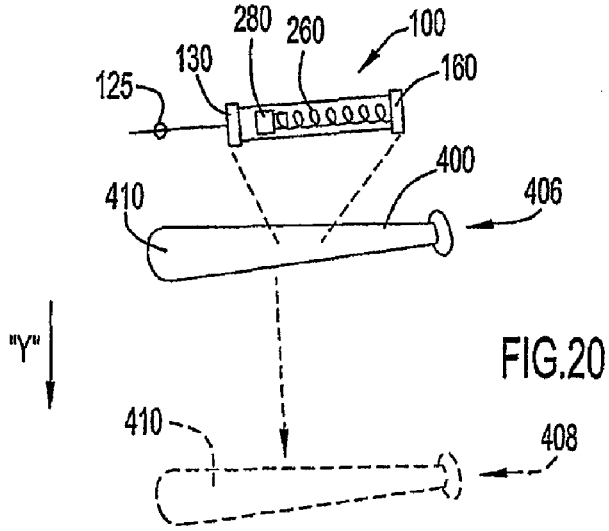
FIG. 20 illustrates a side view of the object illustrated in FIG. 19 in two different positions.

Referring to FIGS. 19-21, an alternative embodiment of an object with which the switch 100 can be used is illustrated. In this embodiment, the object is an object that can be swung by a user. While object 400 is illustrated as a bat, in other embodiments, the object 400 can be a tennis racquet, a golf club, or other article that can be swung or moved by a user.

In this embodiment, the object 400 includes a body 410 with a proximal end 412 and a distal end 414. Referring to FIG. 19, a top view of one type of motion of object 400 is illustrated. A user can swing the object 400 from a start position 402 along the direction of arrow "V" to a swinging or swung position 404, which is indicative of a swinging motion when a user is trying to hit a ball with a bat. During that motion, the distal end 414 moves a greater distance than the proximal end 412 of the object.

A switch 100 can be coupled to the body 410, either internally or externally, and oriented so that the switch 100 detects the desired motion of the object 400. As shown in FIG. 19, the switch 100 is oriented to detect the swinging motion of the object 400 along the direction of arrow "V." In one example, the object 400 can be a bat and the switch 100 is used to teach a proper swinging technique by generating an output or reward, such as an audible and/or visual output, in response to a particular type of swinging motion. If the object 400 is swung in an undesired or incorrect manner, then the switch 100 is not closed and no response is generated. However, if the object 400 is swung in a proper manner, the switch 100 is closed and an output such as sound effects or music is generated.

The switch 100 is oriented so that the primary or detecting axis 125 of the switch 100 is aligned with an axis 415 of the object 400. While object 400 is in position 402, the switch 100 is oriented such that the conductive member 280 can move along the direction "W" and engage the contact of cap 130 to close the switch 100, if the proper force is applied to the conductive member 280. As the object 400 moves along the direction of arrow "V," a centrifugal force acts on the conductive member 280, thereby forcing the conductive member 280 toward the distal end 414 of the body 410 and into engagement with the contact on the cap 130 (see the orientation of the switch 100 and movement along the direction of arrow "X" for object position 404). A proper swinging motion along arrow "V," such as a horizontal motion, can result in conductive member 280 moving and the switch 100 being closed.

Referring to FIG. 20, an exemplary motion of object 400 that is not detected is illustrated. In this example, the object 400 is moved from position 406 to position 408 along the direction of arrow "Y." The switch 100 is oriented such that the primary or detecting axis 125 is aligned with the length of the body 410. Thus, movement of the body 410 along the direction of arrow "Y" does not cause the conductive member 280 of the switch 100 to engage the contact coupled to cap 130. As a result, the switch 100 does not close and no output is generated by the electronic system. The object 400 can be moved in many different planes and directions and the detection of movement in a particular direction or directions can be achieved by orienting the switch 100 in the desired direction.

Referring to FIG. 21, the object 400 is illustrated with a portion removed. The body 410 includes an internal cavity 420 in which the switch 100 is disposed. A cover (not shown) can be provided to allow access to the cavity 410. The switch 100 is oriented so that biasing member 260 is located toward the proximal end 412 and the conductive member 280 is located toward the distal end 414. In different embodiments, the location and manner in which the switch 100 is coupled to the body 410 of the object 400 can vary.

Figure 22:
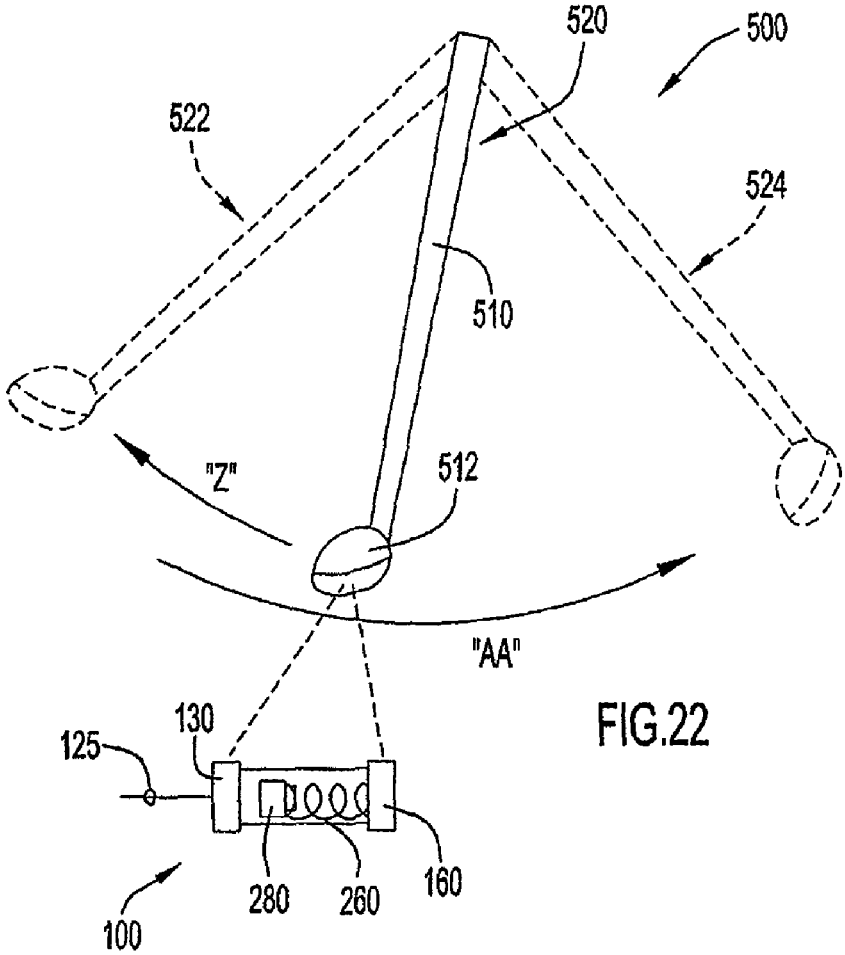
FIG. 22 illustrates a side view of an alternative embodiment of an object that can be used with a switch according to the present invention.
Figure 23:
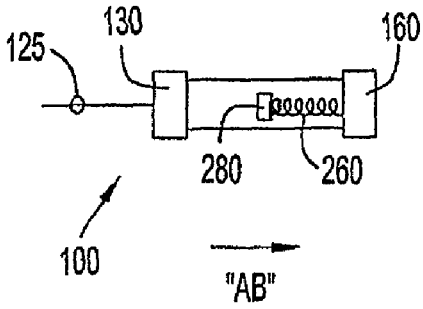
FIG. 23 illustrates the switch of the object illustrated in FIG. 22 in a first configuration.
Figure 24:
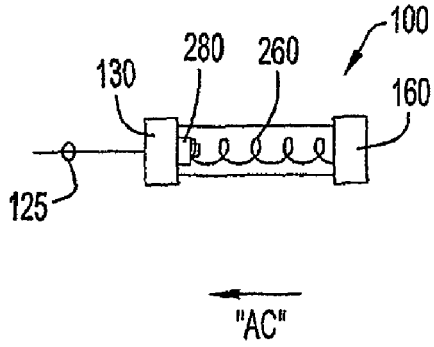
FIG. 24 illustrates the switch of the object illustrated in FIG. 22 in a second configuration.

Referring to FIGS. 22-24, an alternative embodiment of an object with which a switch can be used according to the present invention is illustrated. In this embodiment, the object 500 resembles a golf club. The object 500 can be a real golf club or alternatively, a simulated golf club. The object 500 includes a shaft portion 510 and a club head 512, which in various embodiments can have different shapes and configurations, resembling a driver, a wood, a hybrid, an iron, a wedge, a putter, or other club structure.

FIG. 22 illustrates a view of the object from the perspective of looking at the front of the user. The object 500 can be moved from an initial position 520 to a rearward position 522 along the direction of arrow "Z." The object 500 can then be moved from the rearward position 522 to a forward position 524 along the direction of arrow "AA." The object 500 can be used to teach the proper manner of swinging the object 500 by providing an output when the motion of the object 500 is accurate. Switch 100 can be used to detect motion of the object 500 in a particular direction and if the switch 100 is closed, then an output, such as sound effects or music, is generated. The switch 100 includes end caps 130 and 160 and a conductive member 280 mounted on a resilient member 260 for movement. The switch 100 can be oriented such that the direction of the desired motion is aligned with the primary or detecting axis 125 of the switch 100. Thus, when the object 500 is moved in the desired direction, the switch 100 will close.

Referring to FIG. 23, the switch 100 is illustrated in a configuration that corresponds to movement of the object 500 along the direction of arrow "Z" from position 520 to position 522. As the object 500 is moved along that direction, force on the conductive member 280 moves the conductive member 280 so that it moves along the direction of arrow "AB" and compresses the resilient member 260. In this position, the conductive member 280 does not engage the contact of cap 130 and accordingly, no output is generated.

Referring to FIG. 24, as the object 500 moves from rearward position 522 to forward position 524 along the direction of arrow "AA," the resilient member 260 expands and the conductive member 280 moves along the direction of arrow "AC" in FIG. 24. When the conductive member 280 moves a sufficient distance along the direction of arrow "AC," the conductive member 280 engages the contact proximate to cap 130 and the switch 100 is closed, and an output may be generated by the electronic system. If the object 500 is not moved in a direction that results in the conductive member 280 moving along the axis 125, then the switch 100 is not closed and no output is generated.

The switch 100 can be disposed within a cavity or receptacle formed in the club head 512. In other embodiments, the location of the switch 100 relative to the shaft 510 and the club head 512 can vary. In other embodiments, there can be two switches coupled to the object 500. One switch can be located within the shaft 510 and one switch can be located within the club head 512. In that implementation, an output is generated only when the switch in the shaft and the switch in the club head are both closed. Further, in any of the previous embodiments of objects that are moved, two or more switches can be included with the object to detect motion in multiple directions. Depending on the particular switch that is closed, the output that is generated will vary.

In different embodiments, the orientation of the switch and its movable components can vary as desired. In alternative embodiments, the shape and configuration of the contacts can vary. In addition, the manner in which the contacts are coupled to the end portions can vary, including the quantity of notches and projections that are used.

While the invention has been described in detail and with reference to specific embodiments thereof, it will be apparent to one skilled in the art that various changes and modifications can be made therein without departing from the spirit and scope thereof. For example, it is to be understood that terms such as "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration. Thus, it is intended that the present invention covers the modifications and variations of this invention provided they come within the scope of the appended claims and their equivalents.

What is claimed is:

1. A switch for detecting motion of an object, comprising:

a container including a wall defining an interior region;

a first contact connected to an electronic system, the first contact being located at one end of the container;

a second contact connected to the electronic system, the second contact being located at another end of the container that opposes the one end; and a conductive mechanism being located in the interior region of the container, the conductive mechanism further being engaged with the first contact and selectively engageable with the second contact in response to movement of the object along a first direction and not to movement of the object along a second direction.

2. The switch of claim 1, wherein the conductive mechanism includes a resilient portion and a contact portion, the resilient portion supporting the contact portion for movement.

3. The switch of claim 2, wherein movement of the object back and forth along the first direction moves the contact portion into and out of engagement with the second contact.

4. The switch of claim 2, wherein movement of the object in the second direction does not result in the contact portion engaging the second contact.

5. The switch of claim 2, wherein the resilient portion is a coiled spring.

6. A bouncing toy, comprising:

a base;

a support coupled to the base and being movable relative to the base;

a body coupled to the support and supported for movement relative to the base in a first direction and in a second direction different than the first direction, the body including a surface for supporting a child; and an electronic system including an output device and a motion switch, the motion switch being coupled to one of the body or the support, the motion switch being closed in response to movement of the body in the first direction and not closed in response to movement of the body in the second direction, the output device generating an output in response to the closing of the motion switch, wherein the motion switch comprises a first contact and a second contact, each of the first contact and the second contact being connected to the electronic system, and a conductive mechanism continuously engaged with the first contact and selectively engageable with the second contact in response to movement of the object in the first direction and not to movement of the object in the second direction, movement in the first direction being in a direction away from the first contact.

7. The bouncing toy of claim 6, wherein movement of the body in the first direction moves the conductive mechanism into and out of engagement with the second contact.

8. The bouncing toy of claim 7, wherein movement of the body portion in the second direction does not result in the conductive mechanism engaging the second contact.

9. The bouncing toy of claim 6, wherein the conductive mechanism includes a resilient portion and a conductive portion, the resilient portion supporting the conductive portion for movement.

10. The bouncing toy of claim 9, wherein the resilient portion is a coiled spring.

11. The bouncing toy of claim 9, wherein the resilient portion has a natural frequency characteristic and the conductive portion engages the second contact when the body moves at a frequency substantially the same as the natural frequency of the resilient portion.

12. The bouncing toy of claim 9, wherein the switch includes a container having a wall defining an interior region, the first contact being located at one end of the container and the second contact being located at an opposite end of the container, the resilient portion and the conductive portion being located in the interior region, the conductive portion being selectively engageable with the second contact.

13. The bouncing toy of claim 12, wherein the resilient portion defines a longitudinal axis, and the first direction is substantially aligned with the longitudinal axis.

14. The bouncing toy of claim 12, wherein the container has a length and the resilient portion has an unbiased length, the unbiased length of the resilient portion being greater than the length of the container.

15. The bouncing toy of claim 14, wherein the resilient portion is compressed when the conductive portion is engaged with the resilient portion, the resilient portion when compressed having a length less than the length of the container.

16. The bouncing toy of claim 6, wherein the first direction is substantially vertical and the second direction is substantially horizontal.

17. The bouncing toy of claim 6, wherein the first direction is substantially vertical and the second direction is rotational.

18. A toy, comprising:

a body including a first end and a second end opposite the first end, the body defining a longitudinal axis, the body being movable in a first direction and in a second direction by a user; and a motion switch coupled to the body, the motion switch having a primary axis along which a component of the motion switch can move, the primary axis being substantially aligned with the longitudinal axis of the body, the motion switch being closed in response to movement of the body along the first direction and not being closed in response to movement of the body along the second direction.

19. The toy of claim 18, wherein the motion of the body in the first direction is a swinging motion within a plane and the motion of the body in the second direction is not along the plane.

20. The toy of claim 18, wherein the motion switch further comprises:

a first contact; and a second contact, wherein the component of the motion switch comprises a conductive mechanism continuously engaged with the first contact and selectively engageable with the second contact in response to movement of the body in the first direction and not to movement of the body in the second direction, movement in the first direction being in a direction away from the first contact.

21. A switch for detecting motion in an object, comprising:

a container having a first end and a second end opposite to the first end, the container defining an interior region, the container including:

a first cap coupleable to the first end of the container;

a second cap coupleable to the second end of the container;

a first contact coupled to the first cap and located proximate to the first end of the container; and a second contact coupled to the second cap and located proximate to the second end of the container; and a conductive mechanism located in the interior region of the container, the conductive mechanism including a resilient portion and a conductive portion, the resilient portion being engaged with the first contact and supporting the conductive portion at a position spaced apart from the first contact, the conductive portion being selectively engageable with the second contact in response to movement of the first object along a first direction and not to movement of the object along a second direction different than the first direction.

22. The switch of claim 21, wherein the conductive portion is removably coupled to the resilient portion, and the resilient portion biases the conductive portion away from the first contact and toward the second contact.

23. The switch of claim 21, wherein the container has a length and the resilient portion has a length in an unbiased state, the length of the resilient portion in its unbiased state being greater than the length of the container.

* * * * *